United States Patent [19]

Uehara

[11] 4,375,230

[45] Mar. 1, 1983

[54] APPARATUS FOR FORMING A BAR POSITIONING MEMBER

[76] Inventor: Tsutomu Uehara, 1559-2 Oaza Asano, Kagawa-cho, Kagawa-gun, Kagawa-ken, 7611-11, Japan

[21] Appl. No.: 273,279

[22] Filed: Jun. 12, 1981

Related U.S. Application Data

[62] Division of Ser. No. 954,506, Oct. 25, 1978, Pat. No. 4,318,262.

[51] Int. Cl.[3] ..... B21F 27/10; B21F 1/04

[52] U.S. Cl. ..... 140/102

[58] Field of Search ..... 140/102, 102.5

[56] References Cited

U.S. PATENT DOCUMENTS

| | | | |
|---|---|---|---|
| 468,584 | 2/1892 | Symonds | 140/102 X |
| 2,456,532 | 12/1948 | Perazzo | 140/102.5 X |
| 3,847,189 | 11/1974 | Guzda | 140/102.5 X |

*Primary Examiner*—Kenneth J. Ramsey

*Attorney, Agent, or Firm*—Flynn, Thiel, Boutell & Tanis

[57] ABSTRACT

An apparatus for making a bar positioning member of a single wire which has a plurality of S-shape doubled-back portions spaced along the length thereof to form indentations for receiving metal bars transverse to the wire. The apparatus comprises guide means for intermittently moving a wire along a fixed path and a pendulumlike mold member swingable about the base end thereof. The mold member has a grip to hold an intermediate portion of the wire, and the contour of the base end is shaped in conformity with the shape of the identation. After forming a S-shaped indentation in the wire by rotation of the mold member through about 180° the mold member is retracted to allow the wire to be advanced for formation of the next indentation. Also, notch means on the mold member and corresponding punch means provide an inwardly directed projection for retaining a bar in the indentations.

10 Claims, 16 Drawing Figures

APPARATUS FOR FORMING A BAR POSITIONING MEMBER

This application is a division of application Ser. No. 954 506, filed Oct. 25, 1978, now U.S. Pat. No. 4,318,262.

FIELD OF THE INVENTION

This invention relates to a bar-positioning member which quickly permits the forming of frames or gratelike members from bars, and its forming apparatus. More particularly, it relates to a reinforcing steel bar-positioning member, useful for quickly assembling steel bars into gratelike reinforcements prior to placing concrete in constructing the floor and wall of a reinforced concrete structure, and its forming apparatus.

BACKGROUND OF THE INVENTION

When conventionally constructing a reinforced concrete floor and wall, concrete placement is normally preceded by first putting marks at suitable intervals around the area where reinforcing bars are to be disposed. Then a gratelike reinforcing bar frame is formed by placing reinforcing bars at the marked intervals, and binding together the intersecting bars at their intersecting points with steel wire and so on.

This conventional method requires considerable skill in arranging the reinforcing bars at regular intervals or exactly parallel to each other. In addition, binding them together with wire requires much time. These shortcomings prevent saving the construction cost of using reinforced concrete structures.

Accordingly, an object of this invention is to provide a reinforcing bar-positioning member that eliminates the aforesaid shortcomings by permitting assembling reinforcing bars into a grate or frame quickly and without requiring skill. Another object of this invention is to provide a forming apparatus that can continuously and automatically make said reinforcing bar-positioning member.

SUMMARY OF THE INVENTION

The bar-positioning member according to this invention comprises a steel wire or wire rod. Usually it is used with a reinforcing steel bar, spot-welded on and parallel to the latter. The wire rod has a plurality of bends formed by bending part thereof at given intervals. Each bend constitutes an indentation or a bar-inserting recess to receive a second reinforcing steel bar that is placed intersectingly with respect to said first reinforcing bar. This indentation has only one opening that opens in the direction of the longitudinal axis of the wire rod and a bottom whose shape conforms to the circumference of the second reinforcing bar to be inserted therein. To firmly keep the second reinforcing bar in position, the indentation opening is designed to be smaller than the maximum diameter of the second reinforcing bar, and the bottom shaped to fit close to the circumference thereof. To prevent slipping of the second reinforcing bar out of the indentation, a holding projection is formed opposite to the bottom, which prevents the inserted second reinforcing bar from moving toward the opening, engaging with the circumference thereof. The indentation may also be so designed as to contain a plurality of reinforcing bars, and with a plurality of said projections.

The forming apparatus according to this invention is used for manufacturing the above-described bar-positioning member. It forms said indentations on a long wire or wire rod at desired intervals. This apparatus comprises a main shaft that is intermittently rotated from one side to the other and axially moved back and forth, and an armlike mold member whose base end is fixed to said main shaft. The mold member functions as a mold to form the indentation of said bar-positioning member. The base end shape of the mold member is designed to conform to the cross section of the reinforcing bar to be used. When round steel bars are used, for example, the base end is designed to have a semi-circular contour that is coaxial with the main shaft. When deformed steel bars are used, the base end contour agrees with part of the cross section of the deformed bar.

A groove extending aslant to the longitudinal axis of said mold member opens in the free-end surface of the mold member, the other end of the groove opening on one side of the mold member. This groove receives a long wire or wire rod that is formed into the bar-positioning member, is totally exposed on one side of the mold member, and has a width and a depth that are larger than the diameter of the wire or wire rod. There is a notch on the other side of the mold member, which forms the projection in the indentation of the bar-positioning member. A punch to push part of the wire or wire rod into this notch is provided in the vicinity of the main shaft, interlockingly therewith. When the mold member has completed its rotation, the punch pushes part of the wire into the notch to form the projection in the indentation of the bar-positioning member.

A transfer device to intermittently move the formed wire longitudinally, and a grip device to hold the formed wire, are also provided. These devices are also interlocked with the main shaft.

In the beginning, the main shaft and mold member, not rotating, move axially to receive part of a wire in the groove of the mold member. When the main shaft is turned through a given angle, the wire is longitudinally bent about the axis of the main shaft. At this time, part of the wire is wound around the base end of the mold member to form a bend or an indentation conforming to the contour of the base end. When the rotating main shaft stops, the punch moves ahead toward the notch on one side of the mold member and pushes part of the wire therein to form the holding projection. As the punch withdraws from the notch, the main shaft moves axially again, but in the opposite direction, and the mold member moves toward the wire, whereupon the wire in the groove of the mold member becomes automatically released. Then, the transfer device longitudinally moves the wire through a given length, and the main shaft rotates back through the given angle to return the mold member to the original position.

This apparatus is capable of continuously forming the bar-positioning member having an indentation or eyelike portion, bending part of the wire while moving it longitudinally.

DETAILED DESCRIPTION

Embodiments of the invention will be described by reference to the accompanying drawings. First, however, the conventional reinforcing bar assembling method and its defects will be explained by reference to FIG. 1.

Figure 1:
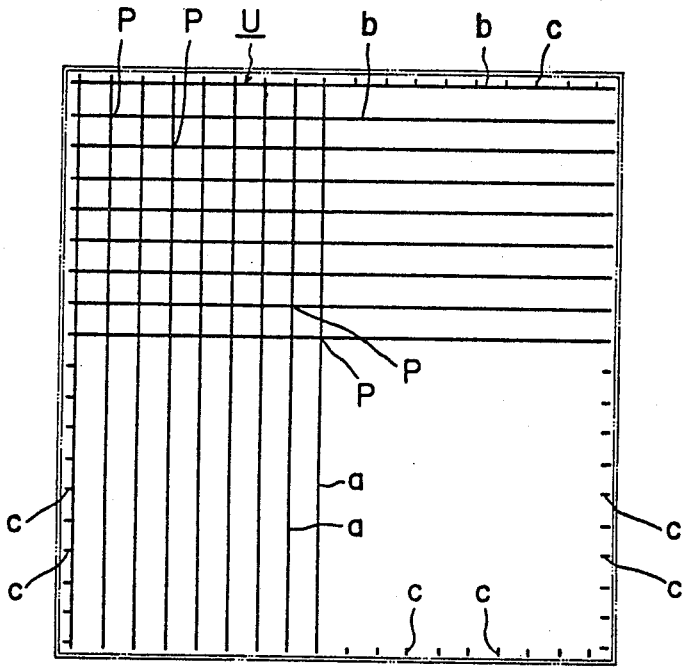
FIG. 1 (PRIOR ART)
FIG. 1 is a plan view illustrating the conventional reinforcing steel bar assembling method.

As shown in FIG. 1, the conventional reinforcing bar assembling method comprises the steps of providing point marks c at given intervals where longitudinal reinforcing bars a and transverse reinforcing bars b are to be placed, placing the longitudinal and transverse reinforcing bars a and b to match the point marks c, and binding together the longitudinal and transverse reinforcing bars a and b at their intersecting points P with steel wire etc. to make up a reinforcing bar assembly U.

But this conventional method requires considerable skill in placing the longitudinal and transverse reinforcing bars with exact intervals and parallelism. In addition, it involves inefficient wire binding of the longitudinal and transverse reinforcing bars at their intersecting points P, which increases the construction cost of reinforced concrete structures.

To eliminate such shortcomings with the conventional method, the inventor invented a bar-positioning member that eliminates the binding and pre-arranging steps, together with an apparatus that can continuously manufacture such bar-positioning members.

Figure 2:
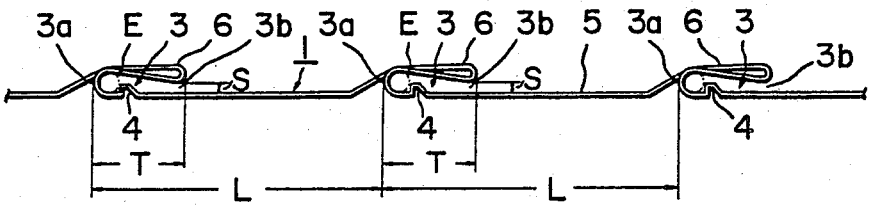
FIG. 2 is a side elevation of a bar-positioning member according to this invention.
Figure 3:
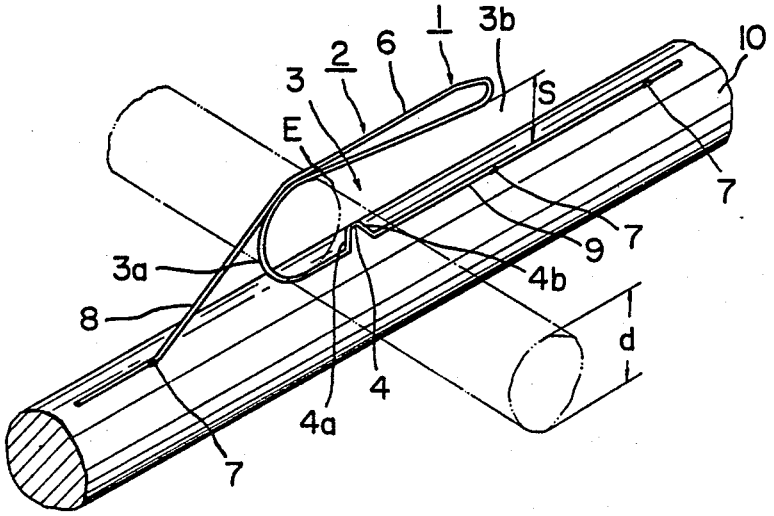
FIGS. 3 through 7 are perspective views showing the bar-positioning member of this invention in use.

FIGS. 2 and 3 show an embodiment of the bar-positioning member according to this invention.

As illustrated in FIGS. 2 and 3, a bar-positioning member 1 is made by bending part of a long wire or wire rod 5 of suitable diameter into a bar-accommodating indentation 3 with an approximately U-shaped bend 2, at suitable even intervals L, and bending another part of the wire 5 toward the inside of said indentation 3 to form a holding projection 4 to prevent an inserted bar from slipping out.

The bar-accommodating indentation 3 of the wire 1 is formed by bending the long wire 5 back to a suitable length T, as indicated by reference numeral 6. The width S of the opening 3*b* of the indentation 3 is somewhat smaller than the diameter d of a reinforcing bar 11 to be inserted therein. The indentation 3 gradually expands from its opening 3*b* toward its bottom 3*a*. The bottom 3*a* has a circular shape that conforms to the circumference of the reinforcing bar 11 to be inserted in the indentation 3. Although the width S of the opening 3*b* is smaller than the diameter d of the reinforcing bar 11, the opening 3*b* can be readily opened by pressing the bar 11 into the bottom 3*a*, the bend 6 over the indentation 3 having adequate elasticity.

The U-shaped bend 2 constituting the reinforcing bar receiving indentation 3 comprises a rising portion 8, the overlapped bend 6, the circular bottom 3*a* and a base portion 9. In the illustrated embodiment, a small projection 4 to prevent the reinforcing bar from slipping out is formed at a suitable position of the base portion 9, preferably in the vicinity of a virtual circle E (having the same diameter as the reinforcing bar 11) contacting the bottom 3*a*.

This projection 4 forms a slope 4*b* on the side of the opening 3*b* and a vertical plane 4*a* on the side of the bottom 3*a*.

Referring now to FIGS. 3 through 6, the method of using the above-described bar-positioning member 1 will be described. As shown in FIG. 3, this member 3 is preliminarily fixed on and throughout the entire length of a reinforcing steel bar 10, disposed parallel to other similar bars, by spot welding 7.

Figure 4:
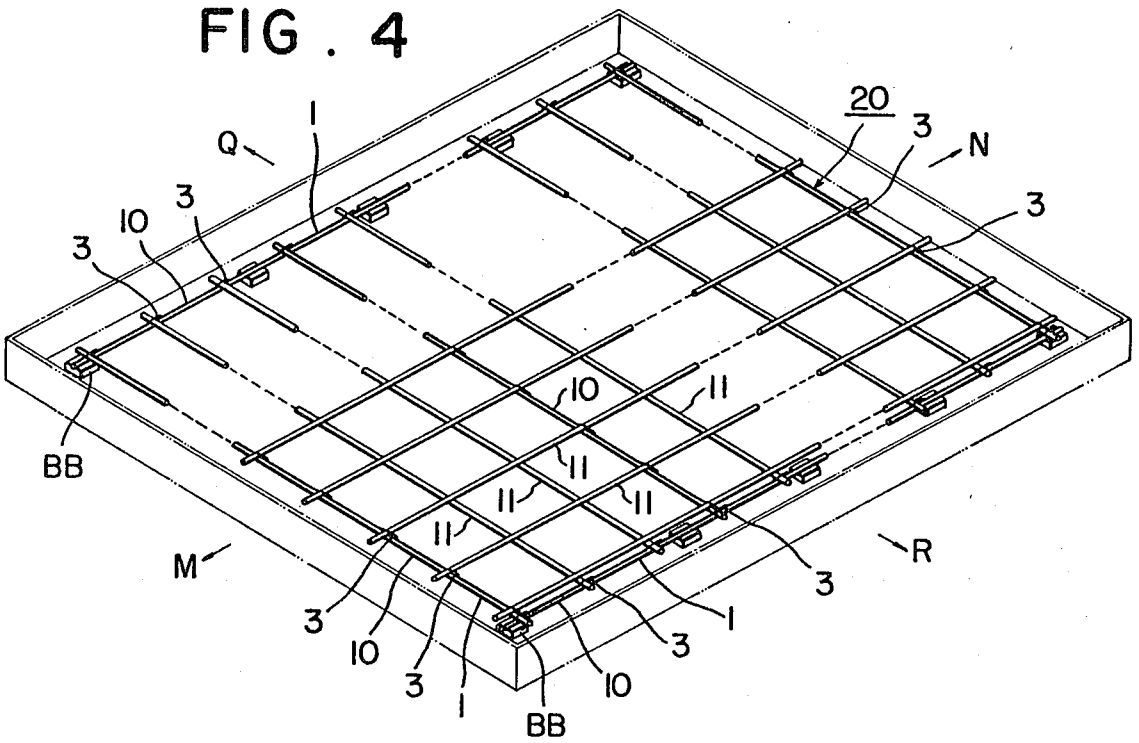
Figure 5:
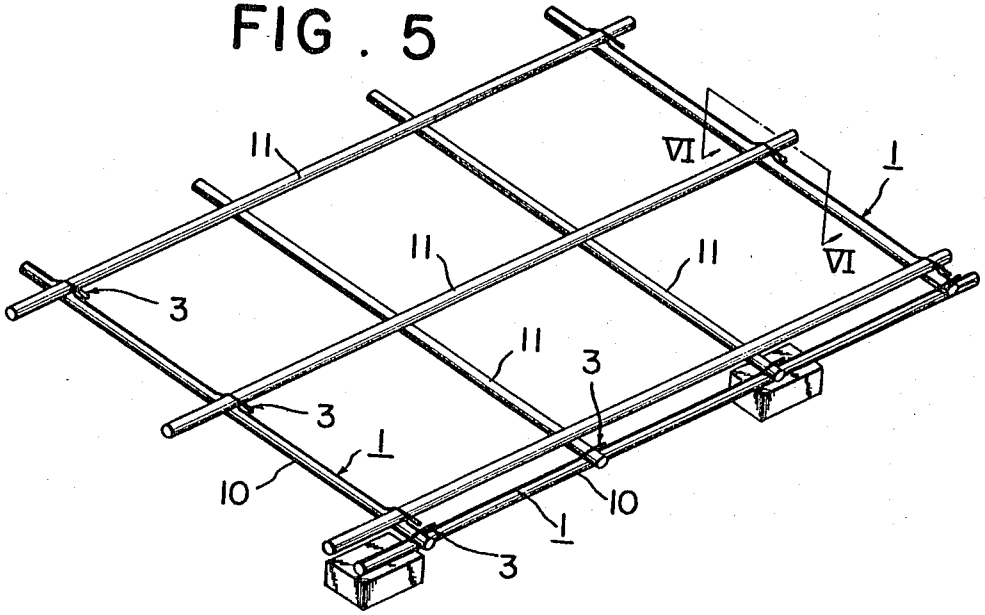
Figure 6:
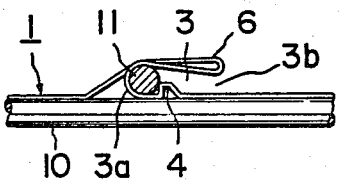

FIGS. 4 through 6 illustrate how to make a reinforced concrete surface (for example, of a base or slab) using the reinforcing bars 10 with said bar-positioning members fixed thereon.

According to this method, a suitable number of reinforcing bars 10 (for instance, this embodiment has two such bars, one on each side), with bar-positioning members thereon, are placed in given positions at given intervals, in the direction of M-N. The bars are placed on blocks BB so that the indentations 3 of the parallel reinforcing bars 10 are aligned in the direction Q-R. Then another set of reinforcing bars 10′ with bar-positioning members thereon, which bars 10′ extend in the Q-R direction, are pressed into the indentations 3 on the first set of reinforcing bars 10, so that the bar-accommodating indentations 3 on the second set of reinforcing bars 10′ are aligned in a straight line in the M-N direction. In this embodiment, the adjacent reinforcing bars 10′ with the bar-positioning members thereon are disposed with two ordinary reinforcing bars 11 therebetween, which bars 11 are devoid of bar-positioning members 1. Then, additional reinforcing bars 11 extending in the M-N direction are press-fitted into the bar-accommodating indentations 3 on the reinforcing bars 10′, thus making up a gratelike reinforcing bar assembly 20.

In press-fitting the second reinforcing bar 10′ (or the ordinary reinforcing bar 11) into the indentations 3 on the first reinforcing bar 10, the second reinforcing bar 10′ (or 11) is pushed along the slope 4*b*, over the projection 4 in the bar accommodating indentation 3 and into the bottom 3*a*. The holding projection 4 thus prevents the reinforcing bar 10′ (or 11) from slipping out of the indentation or recess.

Figure 7:
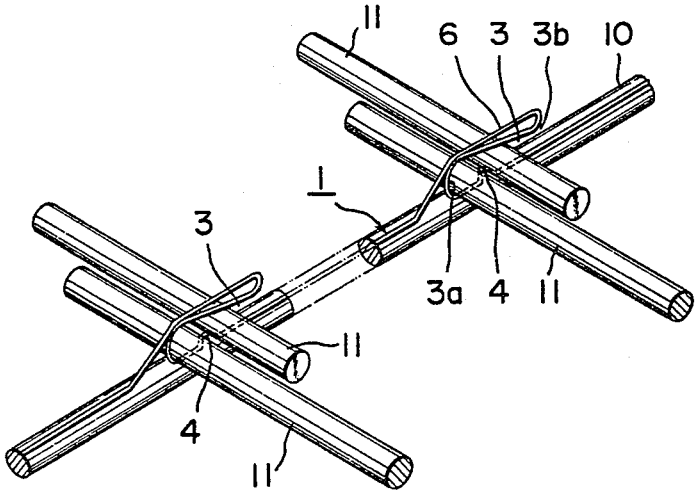

FIG. 7 shows how reinforcing bars are fixed where they are joined together. As seen, two reinforcing bars 11 are inserted in one accommodating indentation 3.

The bar positioning member 1 of this invention is applicable not only to horizontal planes as described above, but also to vertical surfaces of reinforced concrete structures and such structures as bridges and tunnels.

The favorable results achieved by the bar positioning member 1 of this invention are as follows:

1. The bar-positioning member 1 fixed to the reinforcing bar 10 (or 10′) has the bar-accommodating indentations 3 at suitable even intervals. Accordingly, longitudinal and transverse reinforcing bars can be positioned and assembled accurately and quickly by simply press-fitting the intersecting reinforcing bars 11 in the bar-accommodating indentations 3 on the reinforcing bars 10. This simple operation increases working efficiency and enables accurate bar assembling without requiring skill.

2. The holding projection 4 formed inside the bar-accommodating indentation 3 firmly grasps the inserted reinforcing bar 11, which eliminates the need of readjusting the assembled reinforcing bars.

FIGS. 8 through 14 show an apparatus for forming the bar-positioning member 1 shown in FIG. 2. This forming apparatus comprises a pendulumlike mold member swinging intermittently, a main shaft engaging the base end of said mold member and undergoing reciprocating axial and rotating motions, a transfer device to move the formed wire in its longitudinal direction, and a grip device to hold part of the wire being formed.

Figure 8:
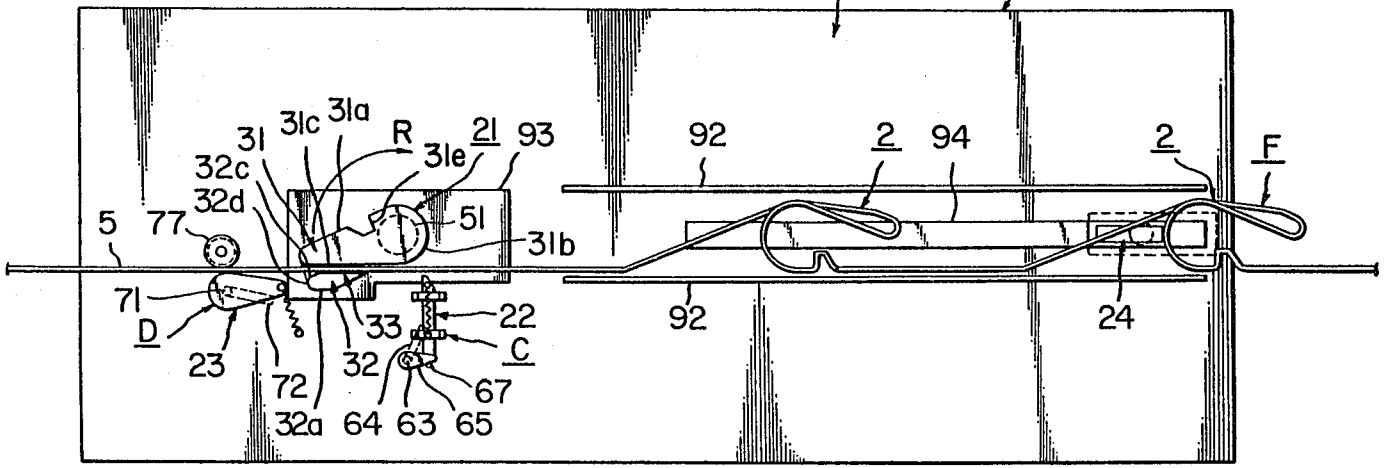
FIG. 8 is a plan view of a forming apparatus of this invention that forms the bar-positioning member in FIG. 2 from a long, straight wire or wire rod.
Figure 9:
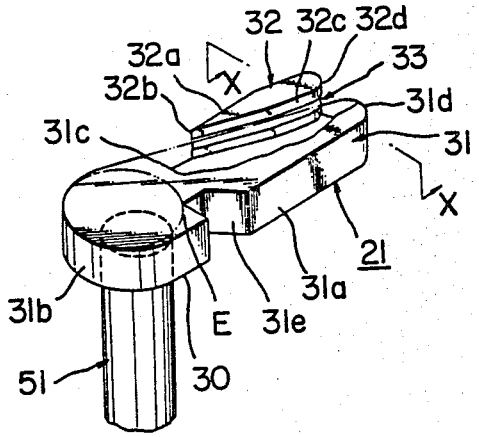
FIG. 9 is a partial enlarged perspective view of the apparatus shown in FIG. 8.
Figure 10:
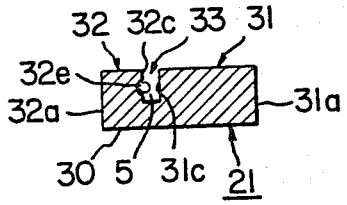
FIG. 10 is a cross-sectional view looking in the direction of the arrow X—X in FIG. 9.

FIG. 8 is a plan view of the forming apparatus looking down from above. Reference numeral 21 designates a cranklike mold member whose base end is fixed to a main shaft 51. The main shaft 51 moves axially at right angles to the drawing and rotates reciprocatingly. As shown in FIG. 9, the mold member 21 is a pendulumlike body 30 extending sideward from the main shaft 51. In the top surface of the body 30 there is cut a groove 33 extending from the free end to one side thereof. As shown in FIG. 10, the width and depth of this groove 33 are considerably larger than the diameter of the wire 5 to be formed. The groove 33 opens outwardly through the top surface of the body 30 of the mold member 21. Therefore, as the mold member 21 moves axially following the axial motion of the main shaft 51, the wire 5 moves in and out of the groove 33, as will be described later. This groove 33 divides the body 30 of the mold member 21 into two sections 31 and 32 (see FIG. 9).

The configuration of the section 31 is defined by a flat side 31*a*, a base end 31*b* consisting of an arc that is coaxial with and slightly larger than the main shaft 51, an inside surface 31*c* sloping from the base end 31*b* to a free end 31*d* so as to intersect with the side 31*a*, and said free end 31*d* consisting of a small-diameter arc. This section 31 has a long ovoid shape.

In this embodiment, the side 31*a* and the inside surface 31*c* (i.e., the wall of the wire holding groove 33) form an angle of approximately 30 degrees.

The configuration of the section 32 is defined by a slightly bent exterior side 32*a*, a sharp-angled rear end 32*b*, an inside surface 32*c* extending parallel to the inside surface 31*c* of the section 31, and a front end 32*d* consisting of a small-diameter arc. Section 32 has a winglike shape, and a smaller area than the section 31.

A trapezoid notch 31*e* is cut in the side 31*a* of the section 31, in the vicinity of a virtual circle E. The arched base end 31*b* forms part of the circumference of the virtual circle E. Also, a groove 32*e* having a semicircular cross section is formed in the inside surface 32*c* of the section 32 to prevent the wire 5 from slipping out (see FIG. 10).

In FIG. 8, reference numeral 22 denotes a punch to press-fit part of the wire 5 into the notch 31*e* of the mold member 21 to form the small projection 4 (see FIG. 2) in the indentation 3. Reference numeral 23 designates a holding member to push the U-shaped bend 2 against the rising portion 8, as will be described later. Item 24 is a wire feed claw to advance the formed wire F, as described hereinafter. The mold member 21, punch 22, holding member 23 and feed claw 24 operate in a given cycle to form the U-shaped bend 2 in the wire 5 and to continuously forwardly advance the formed wire F with the bends 2 therein.

Figure 11:
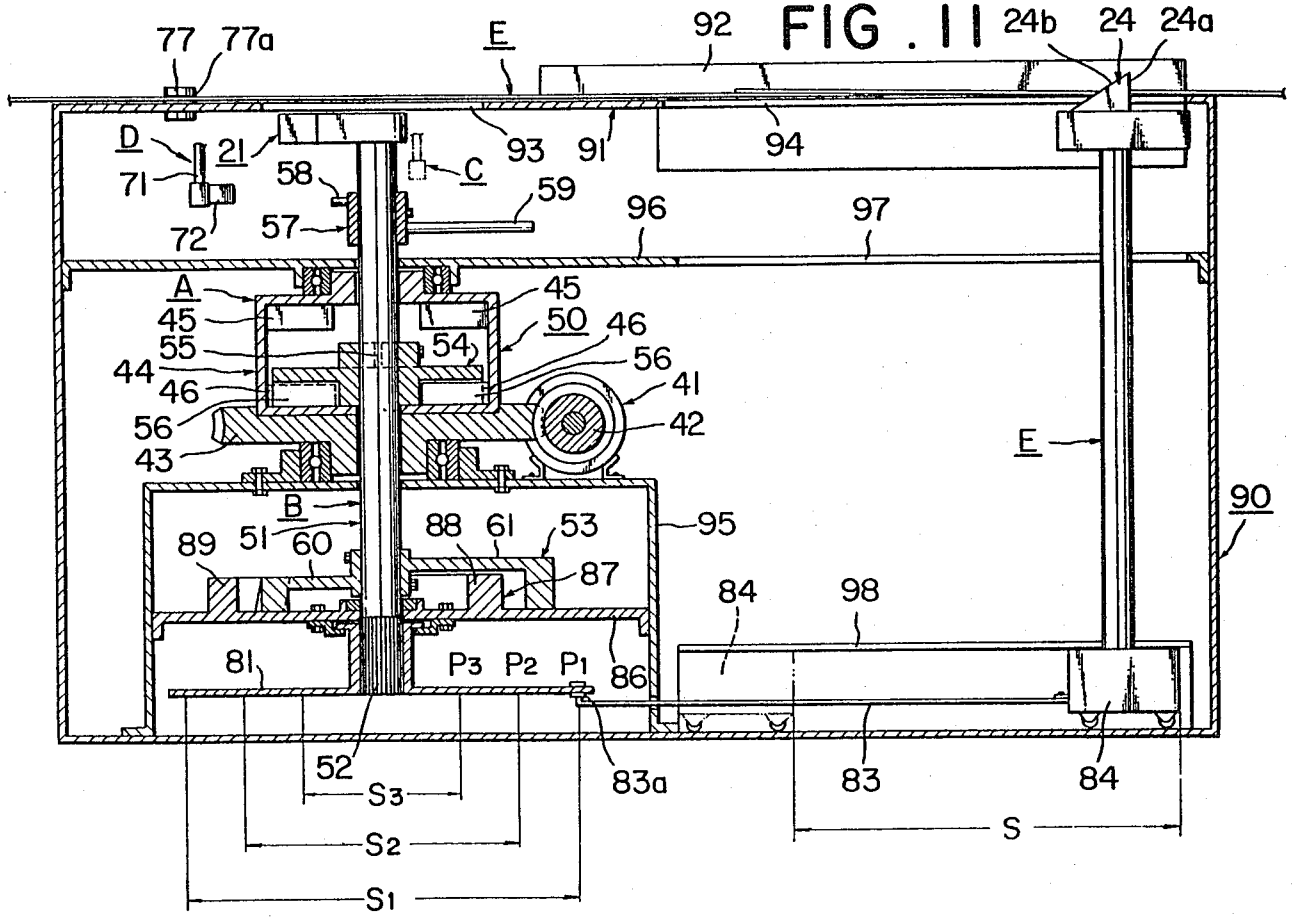
FIG. 11 is a longitudinal cross section of the apparatus in FIG. 8 in the non-operating condition.

Referring now to FIG. 11, a mechanism to drive the mold member 21, punch 22, holding member 23 and feed claw 24 in a given cycle is illustrated.

Figure 12:
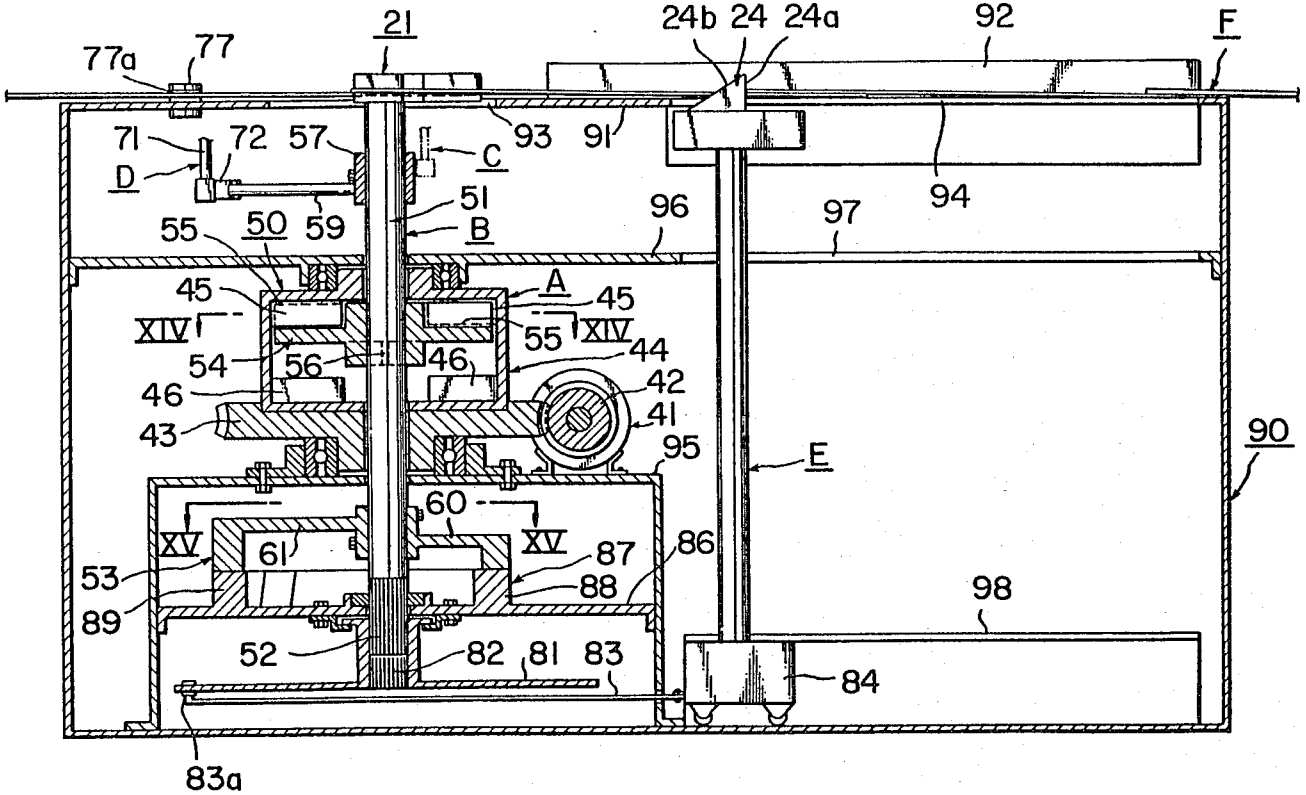
FIG. 12 is a longitudinal cross section of the same apparatus in the operating condition.

FIG. 11 shows the positional relationship between the individual components, with the mold member 21 at a standstill. FIG. 12 shows a similar relationship with the mold member 21 in motion.

The mold member 21 is fixed to the upper end of the main shaft 51 which is rotated by a motor 41 through a clutch mechanism 50 and a pair of gears 42 and 43. Paired upper driving teeth 45 and lower driving teeth 46 are provided inside a cylindrical clutch box 44 that constitutes the driving member of the clutch mechanism 50. The clutch box 44 is welded to gear 43 and rotates continuously and integrally therewith.

Figure 14:
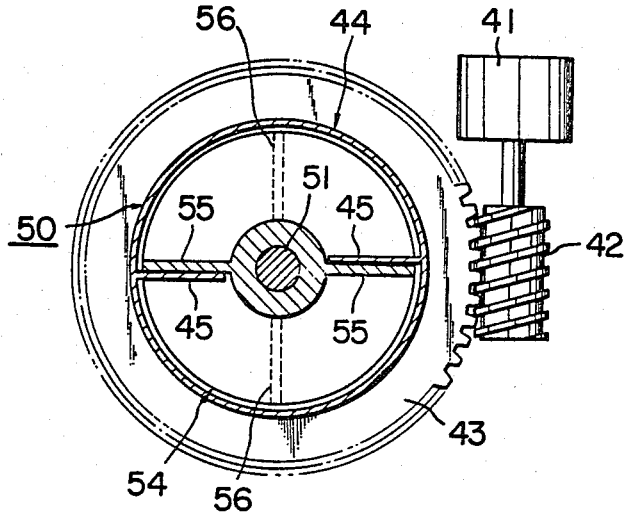
FIG. 14 is a cross-sectional view looking in the direction of the arrow XIV—XIV of FIG. 12.

The main shaft 51 carries a driven disc 54 that is contained in the clutch box 44 and constitutes the driven member of the clutch mechanism 50. Paired upper driven teeth 55 and lower driven teeth 56 are integrally formed above and below the driven disc 54, disposed at right angles with each other as shown in FIG. 14. This driven disc 54 moves up and down with the main shaft 51, as will be described later. It is so designed that not both but either of the upper driven teeth 55 and lower driven teeth 56 of the driven disc 54 alternately engage with the upper driving teeth 45 or lower driving teeth 46, respectively, inside the clutch box 44.

Referring to FIGS. 11 and 12, members carried by the main shaft 51 will be described in descending order. An auxiliary cam device 57 having a camming rod 58 to actuate the punch 22 and a camming rod 59 to actuate the holding member 23 is provided below the mold member 21. A cam follower 53, which moves up and down in contact with a stationary cam 87 (shown in FIG. 15 and described later) and thereby imparts the vertical motion to the main shaft 51, is disposed below the clutch mechanism 50. A crank disc 81 spline-connected with the lower end 52 of the main shaft 51 is provided therebelow.

In FIGS. 8 through 13, reference character C denotes a driving mechanism for the punch 22, D a driving mechanism for the holding member 23, and E a driving mechanism for the feed claw 24.

The punch driving mechanism C comprises said camming rod 58, a driven rod 64 rotated through a given angle by the camming rod 58 when the main shaft 51 rises, a rotatable shaft 63, having rod 64 fixed thereto, a push arm 65 rotating with said shaft 63 to push the punch 22 into the notch 31*e* in the mold member 21, and a spring 66 to return the punch 22 to its original position. Reference numeral 67 designates a stop for the push arm 65.

The holding member driving mechanism D comprises said camming rod 59, a driven rod 72 rotated through a given angle by the camming rod 59 when the main shaft 51 rises, a rotatable shaft 71 fixed to rod 72 and also having said holding member 23 fixed thereto, and a spring 73 to return the holding member 23 to its original position. Reference numeral 74 denotes a stop for the holding member 23.

The feed claw driving mechanism E comprises said rotatable crank disc 81, a reciprocating connecting rod 83 connected thereto, and a linearly reciprocal base unit 84 connected to rod 83 for reciprocating the feed claw 24. The inside of the shaft of the crank disc 81 forms a spline shaft hole 82 (see FIG. 12) to engage with the spline shaft end 52 of the main shaft 51. The reciprocating stroke S (equal to the pitch between adjacent U-shaped bends 2) of the moving base unit 84 or the feed claw 24 may be changed to $S_1$, $S_2$ and $S_3$ according to the positions $P_1$, $P_2$, and $P_3$ where the end 83*a* of the connecting rod 83 is fitted to the crank disc 82.

Figure 15:
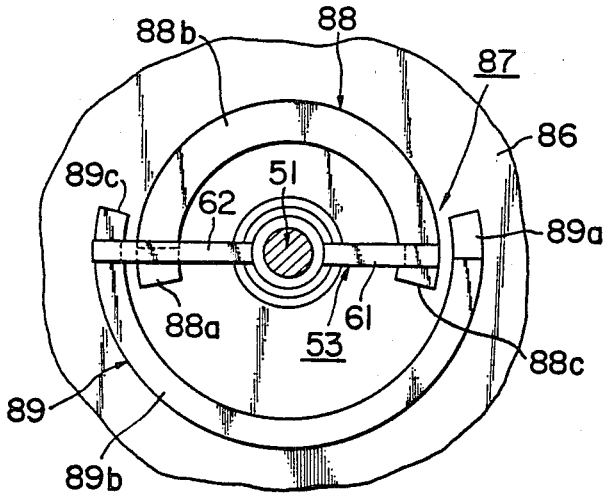
FIG. 15 is a cross-sectional view looking in the direction of the arrow XV—XV of FIG. 12.

As shown in FIG. 15, the stationary cam 87 comprises a small semi-circular inner cam 88 and a large semi-circular outer cam 89 (opposite to the inner cam 88) disposed coaxially about the main shaft 51 on a lowermost support or camming surface 86.

The cam follower 53 comprises an inner follower 61 engageable with the inner cam 88 and an outer follower 62 engageable with the outer cam 89.

The inner cam 88 and the outer cam 89 have inclined camming surfaces 88*a* and 89*a*, flat camming surfaces 88*b* and 89*b*, and vertical camming surfaces 88*c* and 89*c*, respectively. In this embodiment, the flat camming surfaces 88*b* and 89*b* extend through an angle of approximately 200 degrees with respect to the axis of the main shaft 51.

When the inner follower 61 and outer follower 62 ascend along the inclined camming surfaces 88*a* and 89*a*, the main shaft 51 and other items carried thereby (i.e., the mold member 21, auxiliary cam device 57, driven disc 54 and cam follower 53; hereinafter the main shaft 51 and these items are collectively called the driven unit B) also start to rise. When they rest on the flat camming surfaces 88*b* and 89*b*, the driven unit B is in the highest position. When they fall across the vertical camming surfaces 88*c* and 89*c* onto the lowermost camming surface 86, the driven unit B is in the lowest position.

This upward and downward motion of the driven unit B is due to the rotation of the cam follower 53, or that of the driven unit B itself. In other words, it is due to the rotation of the driven disc 54. When moving upward or downward, this driven disc 54 receives rotating force not through both but through either of the upper driving teeth 45 or the lower driving teeth 46 of the clutch box 44.

When the driven disc 54 rises from below (where the lower driving teeth 46 engage with the lower driven teeth 56), the clutch box 44 rotates idle through an angle of approximately 90 degrees until the upper driving teeth 45 engage with the upper driven teeth 55. The same thing occurs when the driven disc 54 descends from above. This is because the upper teeth 55 and lower teeth 56 of the driven disc 54 intersect perpendicularly, while the upper teeth 45 and lower teeth 46 of the clutch box 44 are disposed in the same direction with respect to the common vertical plane.

The object of this design in this embodiment is to insure smooth operation of the entire apparatus by temporarily stopping the driven unit B when it moves up or down.

In the figures, reference character A designates a driving unit including the clutch box 44 and gear 43.

Figure 13:
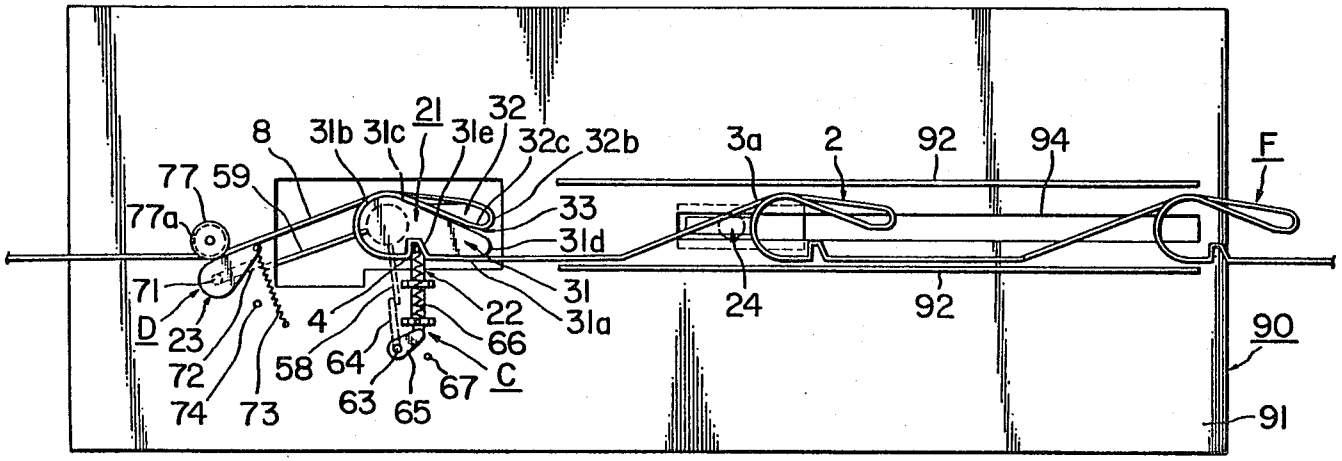
FIG. 13 is a plan view similar to FIG. 8, but showing the apparatus in the operating condition.

In FIGS. 8, 11 and 13, reference numerals 77 designates a guide roller having a groove 77*a* to guide the wire 5, 90 designates a casing to cover the entire apparatus, 91 designates a cover plate for the casing 90, 92 designates guide plates to guide the formed wire F, 93 designates an opening in the cover plate 91 through which the mold member 21 moves in and out, 94 designates a groove through which the feed claw 24 runs, 95 designates a cam chamber cover, 96 designates an intermediate plate, 97 designates a long groove in plate 96, and 98 designates a guide plate for the moving base unit 84.

Now the operation of the forming apparatus of this invention will be described by reference to FIG. 16 which shows the relationship among the above-described driving unit A, driven unit B, holding member 23, feed claw 24, cam follower 53, punch push rod 65 and formed wire F.

Figure 16:
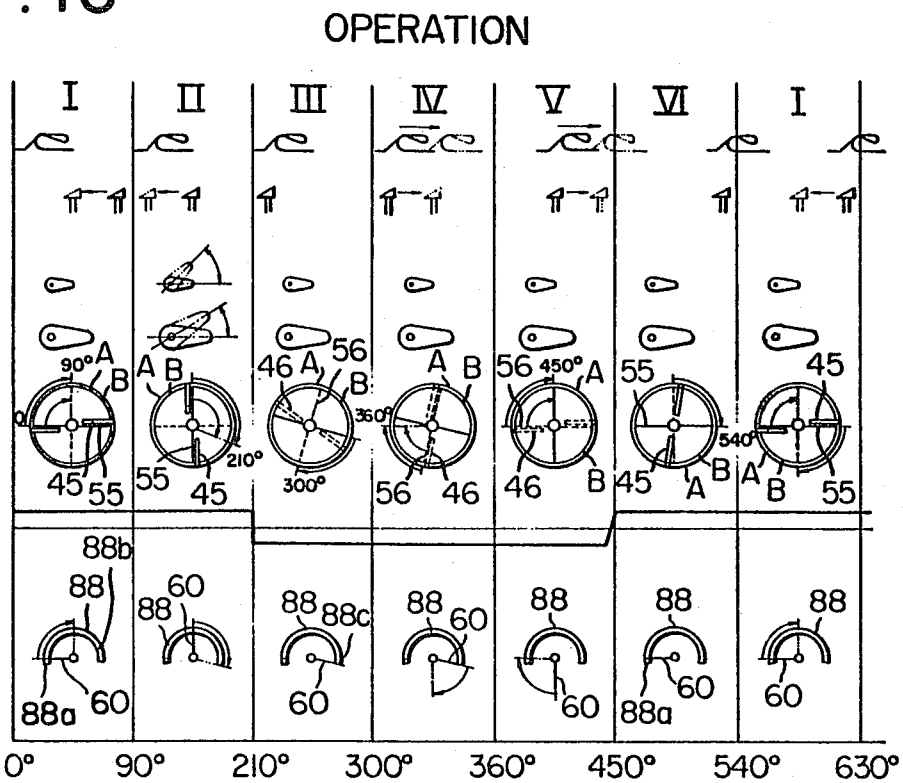
FIG. 16 is a correlation diagram showing the operating cycle of the apparatus of this invention, with the operating conditions of its individual parts.

It is apparent from FIG. 16 that one operating cycle of this apparatus ranges from phase I to phase VI. During this period, the driving unit A rotates 540 degrees (1.5 revolutions), the driven unit B rotates 360 degrees (1 revolution) and makes one up-down reciprocation, the holding member 23 swings back-and-forth once, the feed claw 24 makes one reciprocation, the cam follower 53 rotates one revolution, the punch push rod 65 swings back-and-forth once, and the formed wire F moves longitudinally through a one-pitch distance.

In detail, phase I shows the initiation of a forming cycle. Initially the driven unit B is in its raised position and the follower 60 of cam follower 53 is engaged with flat camming surface 88*b* directly adjacent the upper end of the inclined camming surface 88*a*. In this initial position, the mold member 21 is positioned as shown in FIGS. 8 and 12 so that the wire 5 passes through the grip groove 33. The cam follower 53 then rotates through an angle of 90 degrees along the flat camming surface 88*b*. At this time, the driven unit B is rotated since the upper driven teeth 55 are engaged with the upper driving teeth 45 of the driving unit A. This causes the mold member 21 to be rotated in the direction of arrow R in FIG. 8.

In phase II, the mold member 21 is rotated from the 90-degree position to the 210-degree position. When the mold member 21 has thus rotated 210 degrees, the flat side 31*a* of the section 31 thereof extends in the direction in which the wire 5 is withdrawn. During phases I and II, the wire 5 is wound around the mold member 21 to form the U-shaped bend 2, as shown in FIGS. 2 and 3.

In the later period of phase II, the holding member 23 and the punch push rod 65 are swung into the FIG. 13 positions to straighten the rising portion 8 of the U-shaped bend 2 and to form the projection 4, respectively.

While the mold member 21 rotates from the 0-degree position to the 210-degree position during phases I and II, the feed claw 24 returns from the advanced position (FIGS. 8 and 11) to the retracted or original position (FIGS. 12 and 13).

At the end of phase II, that is when the driving unit A has rotated through an angle of 210 degrees, the cam follower 53 disengages from the cams 88 and 89 and the driven unit B descends, thus disengaging the mold member 21 from the wire 5. At the same time, the upper driving teeth 45 of driving unit A are disengaged from the upper driven teeth 55 of driven unit B, and the driven unit B stands still.

In phase III, the driving unit A rotates from the 210-degree position to the 300-degree position, but the driven unit B and other members remain stationary. At the end of phase III, the lower driving teeth 46 of driving unit A are positioned in engagement with the lower driven teeth 56 of the driven unit B.

The driving unit A then rotates 60 degrees during phase IV and an additional 90 degrees during phase V (i.e., from the 300-degree position to the 450-degree position), and the driven unit B also rotates through the same angle, or 150 degrees. During this period, the mold member 21 rotates, in its lowered position, returning from the condition of FIG. 13 to the initial condition of FIG. 8. The feed claw 24 also advances from the position of FIG. 13 to that of FIG. 8, pushing the bottom 3*a* of the U-shaped bend 2 and moving forward the formed wire F by one pitch.

At the end of phase V, the cam follower 60 re-engages the inclined cam surface 88*a* to raise the driven unit B so that mold member 21 is lifted to re-engage wire 5 within groove 33. Also, the lower driving teeth 46 of the driving unit A are disengaged from the lower driven teeth 56 of the driven unit B. The driving unit A then rotates idle through an angle of 90 degrees, from the 450-degree position to the 540-degree position, during phase VI.

Between phases I and VI, the driving unit A rotates through a total angle of 540 degrees (1.5 revolutions), while the driven unit B rotates 360 degrees (1 revolution) and makes one up-down reciprocation. During the same period, the mold member 21 turns, gripping the wire 5 in the groove 33, to form the U-shaped bend 2. The feed claw reciprocates once to advance the formed wire F by one pitch.

The foregoing embodiments describe the use of the bar-positioning member with round reinforcing steel bars mainly for building use. This invention is also applicable for deforming reinforcing bars whose cross sections are not exactly circular. In such applications, the bottom 3*a* of the member 1 is shaped in conformity with the cross section of the bar to be deformed. Likewise, the configuration of the base end of the mold member 21 is shaped similar to the cross section of the deformed bar.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. Apparatus for manufacturing a series of bar positioning members from a continuous elongate metal wire or the like, wherein the bar positioning member has an indentation and a projection protruding into such indentation, the apparatus comprising:

means defining a path along which said wire is advanceable in a downstream direction;

a main shaft intermittently rotatable from one side to the other and axially advanceable and retractable with respect to said wire path;

an armlike mold member having a base end and a free end, said base end being fixed to said main shaft and shaped to form said indentation of said bar positioning member, said mold member having a groove extending aslant of the length of the mold member, said groove opening through the free end of the mold member and through one side of the mold member to receive the wire to be formed into the bar positioning member, said groove being totally exposed in one axial face of the mold member and having a width and depth larger than the diameter of the wire, said mold member having a notch on the other side thereof for forming said projection in said indentation of said bar positioning member;

a punch for pushing part of the wire into said notch, said punch being operatively connected with said main shaft for causing the punch to push part of the wire into the notch to form the projection in the indentation of the bar positioning member when the mold member has completed its rotation;

a transfer device operatively connected with said main shaft for intermittently moving the formed wire longitudinally; and a holding device operatively connected with said main shaft to hold the formed wire.

2. The apparatus of claim 1, including:

means for axially advancing the main shaft and mold member to receive part of the wire in said groove of said mold member;

means for rotating said main shaft through a given angle to wind part of the wire around said base end of said mold member and thereby form said indentation in conformance to the contour of said base end;

means responsive to completing of said rotation of said main shaft for moving the punch ahead toward said notch in said one side of said mold member to push part of the wire thereinto to form said projection and then for withdrawing said punch;

means for axially retracting said main shaft and mold member away from said wire, whereupon the wire is automatically released from said groove of said mold member; and means causing said transfer device to longitudinally advance the wire through a given length and permitting the main shaft to rotate back through said given angle to return said mold member to its original position;

whereby to continuously form a bar positioning member having an indentation by bending part of the wire while moving it longitudinally.

3. The apparatus of claim 1, including a drive motor and a clutch for connecting the latter to said main shaft, said clutch including a driven disk fixed to said main shaft and having paired upper driven teeth and lower driven teeth respectively fixed to the top and bottom of the driven disk and disposed substantially at right angles with respect to each other circumferentially of said disk, said clutch further including a driving member driven by said motor and carrying a pair of upper driving teeth and a pair of lower driving teeth which are substantially coplanar with each other and are disposed on opposite axial sides of said driven disk and are axially spaced sufficient that either but not both of said upper driving teeth and lower driving teeth are engageable with corresponding ones of the upper and lower teeth on said driven disk, such that said main shaft in its axially advanced position is rotated by said motor through said upper teeth of said driven disk and driving member, and wherein said main shaft in its retracted position is rotatably driven by said motor through said lower teeth of said driven disk and driving member, the circumferential offset of the upper teeth from the lower teeth on said driven disk providing circumferential lost motion in rotational driving of said main shaft when said driven disk is shifted axially between said upper and lower driving teeth, so as to provide periodic intervals in which the main shaft does not rotate, despite continued rotation of said motor.

4. The apparatus of claim 1, including means for actuating said punch comprising a camming rod fixed to and extending away from said main shaft for rotation therewith, a driven rod rotated through a given angle by said camming rod when said main shaft extends, a shaft rotatable about an axis fixed beside said wire path, said driven rod and a push arm being fixed to said shaft for rotation therewith, said push arm being engageable with said punch to push the latter into said notch in said mold member, and a spring arranged to return said punch to its original position away from said mold member upon release of said driven rod by said camming rod.

5. The apparatus of claim 1, including means for driving said holding device and including a camming rod fixed to and extending from said main shaft, a driven rod rotatable through a given angle by said camming rod as the main shaft extends, a rotatable shaft fixed for rotation about an axis adjacent said wire path, said driven rod and a holding member being fixed to said rotatable shaft for engaging said holding member with said wire, and spring means for returning said holding member to a position out of holding engagement with the wire upon release of said driven rod by said camming rod.

6. The apparatus of claim 1, in which said transfer device comprises a rotatable crank member fixed to and rotatable with said main shaft, a reciprocating connecting rod connected to said crank member for reciprocation thereby, a linearly reciprocable base unit movable along the wire path and a feed claw fixed to said reciprocable base unit and engageable with the completed bar positioning member for advancing same and thereby advancing fresh wire into the region of said mold member, and means for adjusting the stroke of said base unit provided by rotation of said crank member.

7. The apparatus of claim 1, including means for advancing and retracting said main shaft comprising larger and smaller radius radially inner and outer cams fixed with respect to the wire path with said inner cam on one side of said main shaft and said outer cam disposed opposite thereto on the other side of said main shaft, said cams being substantially centered on said main shaft, a cam follower comprising an inner follower member engageable with said inner cam and an outer follower member engageable with said outer cam, said inner and outer cam follower members being fixed with respect to each other and to said main shaft for rotation therewith, said inner and outer cams being carried by a support surface surrounding said main shaft, such that the extended and retracted positions of said main shaft depend upon whether said followers contact said cams or said support surface.

8. In an apparatus for making a bar positioning member from a continuous elongate metal wire or the like, said bar-positioning member having at least one indentation, the improvement comprising:

means defining a path along which said wire is disposed, the path having upstream and downstream portions;

an elongate pendulumlike mold member located along said path, said mold member having a base end containing an axis about which said mold member is pivotable with respect to said path and between first and second positions, said mold member having grip means fixed on its other end remote from said axis and lying on said path upstream of said axis in said first position of said mold member for receiving and gripping an intermediate portion of said wire, said base end of said mold member having a wire engageable perimeter partially surrounding said pivot axis and shaped in the desired shape of said indentation to be produced in said wire;

means for rotating said mold member about said pivot axis from the first position to said second position wherein said grip means is downstream of said axis in said second position whereby to form said wire into a substantial S-shape with one portion bent around said gripping means and the other reversely bent around said base end perimeter to form said indentation of the bar positioning member to be produced.

9. The apparatus of claim 8, including:

means for retracting said mold member away from said wire path and thereby permitting said longitudinal advancement of said wire therepast, said retracting means being actuable for advancing said mold member toward the wire path and thereby engaging said intermediate portion of said wire in said mold member grip means, said wire path having an outlet portion beyond said mold member to which the bar positioning member is advanceable upon said retraction of said mold member from said wire path by said mold member retracting means.

10. The apparatus of claim 9, including means for advancing successive portions of said wire past said mold member in concert with repetitive actuation of said rotating means and retracting means for forming a series of indentations, and hence of said bar retaining members, in said wire.

* * * * *